US011787611B2

(12) United States Patent
Trollope

(10) Patent No.: US 11,787,611 B2
(45) Date of Patent: Oct. 17, 2023

(54) SECURE STORAGE APPARATUS

(71) Applicant: Power Box AG, Zug (CH)

(72) Inventor: Tim Trollope, Somerset (GB)

(73) Assignee: Power Box AG, Zug (CH)

( * ) Notice: Subject to any disclaimer, the term of this patent is extended or adjusted under 35 U.S.C. 154(b) by 0 days.

(21) Appl. No.: 17/314,389

(22) Filed: May 7, 2021

(65) Prior Publication Data

US 2021/0347543 A1 Nov. 11, 2021

(30) Foreign Application Priority Data

May 11, 2020 (GB) ..... 2006920

(51) Int. Cl.

| | |
|---|---|
| ***B65D 55/14*** | (2006.01) |
| ***B65D 25/20*** | (2006.01) |
| ***B65D 25/28*** | (2006.01) |
| ***B65D 43/16*** | (2006.01) |

(52) U.S. Cl.

CPC ..... *B65D 55/14* (2013.01); *B65D 25/20* (2013.01); *B65D 25/2808* (2013.01); *B65D 43/163* (2013.01)

(58) Field of Classification Search

CPC .... B65D 55/14; B65D 25/20; B65D 25/2808; B65D 43/163; B65D 55/024

USPC ..... 220/315

See application file for complete search history.

(56) References Cited

U.S. PATENT DOCUMENTS

| | | | | |
|---|---|---|---|---|
| 3,747,541 A | | 7/1973 | Reese | |
| 4,645,397 A | * | 2/1987 | Howe | F16B 41/005 411/372.6 |
| 4,782,977 A | * | 11/1988 | Watanabe | B65D 55/024 292/307 R |

(Continued)

FOREIGN PATENT DOCUMENTS

| | | |
|---|---|---|
| DE | 19604677 C1 | 11/1996 |
| FR | 2852521 A1 | 9/2004 |

(Continued)

OTHER PUBLICATIONS

Asgard Secure Steel Storage, Asgard shed lock options, 2014, Asgardsss.co.uk (pp. 10).

(Continued)

*Primary Examiner* — J. Gregory Pickett
*Assistant Examiner* — Niki M Eloshway
(74) *Attorney, Agent, or Firm* — Woodard, Emhardt, Henry, Reeves & Wagner, LLP

(57) ABSTRACT

A storage apparatus which allows the secure storage of items within a cavity defined by a base, side walls and a top. Access can be gained to the cavity to allow the removal of introduction of said items by moving a portion of the apparatus between open and closed positions. Locking means are provided to allow the said portion to be retained in a closed position and at least one part of the apparatus is or is provided with at least one sacrificial element such that if a force is applied thereto in an attempt to break the locking means and gain unauthorised access to the cavity, the sacrificial element will break before a sufficient level of force can be applied to break the locking means and hence (Continued)

prevent the said at least one part being used as a means to exert force to break the locking means and gain unauthorised access and theft of items from the said cavity.

20 Claims, 6 Drawing Sheets

(56) References Cited

U.S. PATENT DOCUMENTS

| | | | | |
|---|---|---|---|---|
| 5,397,012 | A * | 3/1995 | Tison | B65D 47/0842 215/253 |
| 5,921,119 | A | 7/1999 | Myers | |
| 6,877,631 | B1 * | 4/2005 | Thompson | B65D 55/024 215/249 |
| 7,159,733 | B2 * | 1/2007 | Pickles | B65D 1/22 220/265 |
| 2003/0080571 | A1 * | 5/2003 | Schainholz | A61L 2/28 292/310 |
| 2007/0199182 | A1 * | 8/2007 | Johnson | A44B 11/2542 24/265 BC |
| 2010/0133126 | A1 * | 6/2010 | Shute | E05B 47/004 220/323 |
| 2011/0095028 | A1 | 4/2011 | Larson | |
| 2015/0083726 | A1 * | 3/2015 | Zacchi | B65D 55/024 220/315 |
| 2017/0096264 | A1 * | 4/2017 | Anderson | B65D 43/163 |
| 2019/0203872 | A1 | 7/2019 | Cifuentes Lopez | |

FOREIGN PATENT DOCUMENTS

| | | | | |
|---|---|---|---|---|
| GB | 2157363 | A | 10/1985 | |
| WO | WO-2012148903 | A2 * | 11/2012 | B65D 21/0217 |

OTHER PUBLICATIONS

Machine translation of DE19604677C1 by PatDocs on Dec. 27, 2021 (pp. 19).
Machine translation of FR2852521A1 by PatDocs on Dec. 27, 2021 (pp. 10).
Search Report issued by European Patent Office in related EP21172734 dated Sep. 14, 2021.
Search Report issued by UK Patent Office for related GB2106515.6 dated Oct. 14, 2021.

* cited by examiner

SECURE STORAGE APPARATUS

CROSS-REFERENCE TO RELATED APPLICATIONS

This application claims the foreign priority benefit of United Kingdom Patent Application No. 2006920.9 filed May 11, 2020, which is hereby incorporated by reference.

BACKGROUND

The invention to which this application relates is to improvements to secure storage apparatus and, in particular, to storage apparatus which is provided for the secure and safe location of tools, implements, fuel and other items which may be used, typically, on a day to day basis but which are required to be stored securely so as to allow the same to be available when next required to be used and to prevent the theft of the same from the storage apparatus, if for example the tools are stored in the same overnight. Yet further, the apparatus is particularly for use in conjunction with a vehicle or a storage building such as a garage. The storage apparatus can then be provided to be secured in position with the vehicle or a surface of a building and the aim is to be able to prevent removal of the apparatus as a whole from the surface or surfaces to which the apparatus is secured and/or to prevent access being gained to the interior of the apparatus to obtain and remove items therefrom.

It will therefore be appreciated that with apparatus of this type, there are two main security concerns, the removal of the apparatus as a whole from a secure location so as to allow further work to be undertaken to gain access to the interior of the apparatus at a remote location so as to gain access to the contents and the second concern is to prevent access to the interior to the apparatus and items stored therein.

It is known that many forms of this type of apparatus are commercially available and which claim to be secure and, while the security of the same may in certain instances be questionable, the level of security may be sufficient to deter relatively casual potential thieves. However, it is quite often the case that the apparatus is not sufficiently secure to be able to withstand a more determined and/or skilled attempt to breach the same. Yet further, it is known that from time to time, those persons who are skilled in gaining access to this type of apparatus will become aware of a particular weak point in the apparatus security and thereby be able to exploit this weak point and perform a large number of thefts until the weakness issue is resolved.

When one considers that the tools secured in the apparatus, may, individually, be expensive and, when a number of tools are secured together, it will be appreciated that theft of all the tools, can have significant impact financially on the owner of the tools, may prevent the owner from operating their business and/or results in insurance premiums for theft becoming expensive or possibly impossible to obtain. As a result there is a need for genuinely secure apparatus to be used by many individuals and businesses.

SUMMARY

The aim of the present invention is therefore to provide secure storage apparatus in a form which improves the security of the apparatus and increases the difficulty and/or time required to gain access to the storage area of the apparatus. A further aim is to improve the security of the apparatus so as to prevent and/or increase the difficulty of removal of the apparatus as a whole unit from another item or structure to which the same is secured.

A further aim is to incorporate both of the said improvements in the same security apparatus to thereby provide the apparatus in an overall improved format so as to maintain the security of the items stored therein.

In a first aspect of the invention, there is provided a storage apparatus including a body formed by a base, top and sidewalls, which define a storage cavity therein, at least one portion of the apparatus moveable between open and closed positions so as to allow access to be gained to the storage cavity when the said at least one portion is in an open position to allow the positioning of items therein and the removal of items therefrom, locking means which allow the said at least one portion to be locked in the closed position and/or the apparatus to be locked to a support structure, wherein the apparatus includes at least one sacrificial element so that upon an attempt being made to gain access to the said cavity and/or remove said apparatus from said securing structure whilst said locking means are locked, by applying a force to, or via at least one part which is, or includes, said sacrificial element, said sacrificial element will break or be at least partially detached from the apparatus so as to reduce the possibility of the said force being applied to said at least one part to a level sufficient to gain access to said cavity and/or remove said apparatus from said securing structure.

In one embodiment, the said part has a function during use of the apparatus and the said sacrificial element is provided to have sufficient strength so as to allow said part to be used for its said function but the sacrificial element is provided to be breakable or detachable from the remainder of the apparatus when a greater level of force which would be sufficient to break the locking means or otherwise gain access to the cavity, or detach the apparatus from a securing surface, is applied thereto.

In one embodiment the aim of the unauthorised access attempt, is to allow access to the cavity so as to then allow theft of items from the cavity and/or allow further actions to remove the apparatus to be removed and separated from a structure to which the same is securely attached.

In one embodiment the said part is a handle, said handle provided to allow the apparatus as a whole to be moved by gripping one or more of said handles and/or to allow said one or more handles to be gripped to move one or more portions of the apparatus between open and closed positions.

In one embodiment, the at least one sacrificial element includes securing means in the form of screws which are provided to have sufficient strength so as to secure the part to a side wall, top and/or bottom surface of the apparatus but do not have sufficient strength to be able to allow the handle or other part to be maintained in attachment to the said side wall, top or bottom surface when a force greater than a predetermined force is applied to the same in order to attempt to gain said unauthorised access.

In one embodiment, the screws have a predetermined upper force limit at which the same are designed to break and hence cause the part to break or be detached from the said apparatus and therefore prevent further force being applied thereto and allow the remainder of the apparatus to be intact and still secure.

In one embodiment, the apparatus is provided to be engaged directly to a securing structure such as the interior space of a vehicle, such as a rear of a van, or a securing structure in the form of a building and the apparatus is secured to a wall or floor or roof of the securing structure. Alternatively, the apparatus may be located on a securing plate or base and which in turn is secured to the securing structure. Yet further the apparatus may be independent of any securing structure so as to be movable and carried away from any such securing structure.

In one embodiment the said movable portion of the apparatus is provided in the form of lid which can be moved about a pivot axis between open and closed positions.

In one embodiment, the said hinge mechanisms which control the pivotal movement are located entirely within the cavity when the lid is in the closed position.

In one embodiment, the hinge mechanisms are engaged to side walls and/or the lid portion of the apparatus such that the engagement means are not visible or accessible from the external surfaces of the apparatus and so prevent unauthorised attempts being made to operate the same, in order to allow the lid to be moved with respect to the remainder of the apparatus.

In one embodiment, the lid is provided such that when the same is in a closed position the side walls of the lid portion are substantially flush with the adjacent side walls of the body of the apparatus and so prevent the lid from being used as an anchor or leverage means to attempt to force the lid to an open position using force applying apparatus such as a jack.

In one embodiment, the said part which is or includes the one or more sacrificial elements is attached to the lid.

Typically the locking means comprise one or more locking members which engage between the lid and the body of the apparatus.

In another embodiment, the apparatus the said one or more portions are one or more drawers which can be moved between a closed position in which the same are located within the cavity of the body and an open position at least partially removed from the cavity of the body so as to allow access to be gained to the drawer and the items stored therein.

Typically, in this embodiment, the one or more sacrificial elements are handles or securing means to attach said handles to the drawers so as to allow movement of the drawers between open and closed positions.

In this embodiment the locking means include, for each drawer at least one locking member which engages the respective drawer in a locked position with the body of the apparatus, when in a locked position.

In another embodiment, the one or more sacrificial elements and parts are attached to side walls of the apparatus body and are provided to function so as to allow the apparatus as a unit, to be carried and moved by one or more users.

In a further aspect of the invention, one or more portions of the external faces of the apparatus are formed of a compound metal or metal alloy which when attempts are made to cut through the same cause respective layers or components of the same to separate and thereby resist attempts to cut through the same.

In one embodiment the said compound material is located at or adjacent to locking means so as to provide resistance to gaining access to break or cut through the lock components. In addition or alternatively the said compound material is located at or adjacent to engagement means for a hinge mechanism for a lid of the apparatus.

BRIEF DESCRIPTION OF THE DRAWINGS

Specific embodiments of the invention are now described with reference to the accompanying drawing wherein.

DETAILED DESCRIPTION OF THE DRAWINGS

Figure 1A:
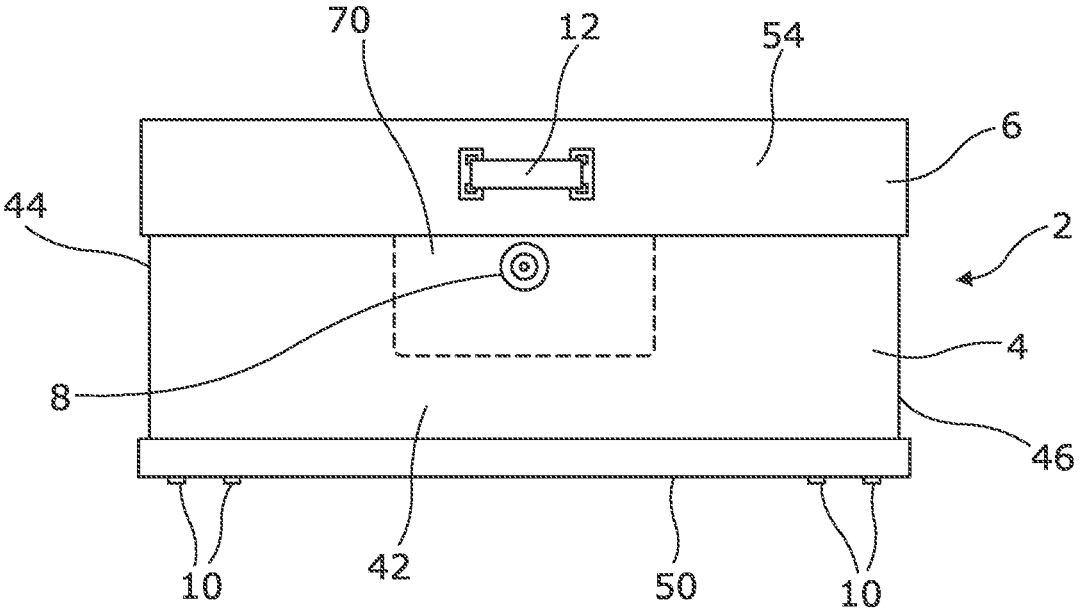
FIGS. 1*a-f* illustrate first, second and third embodiments of apparatus in accordance with the invention.
Figure 1B:
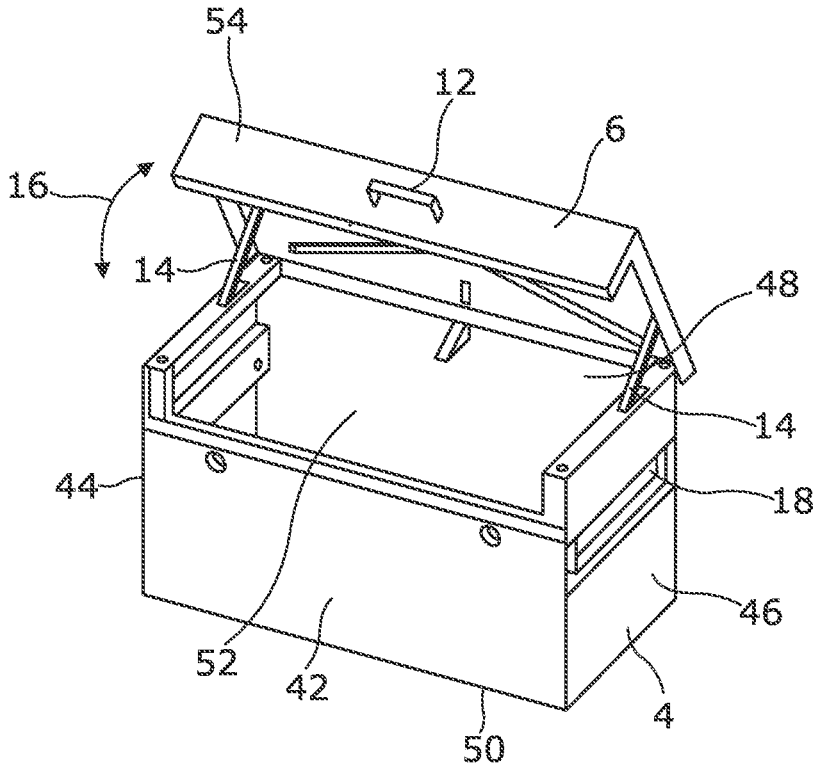
Figure 1C:
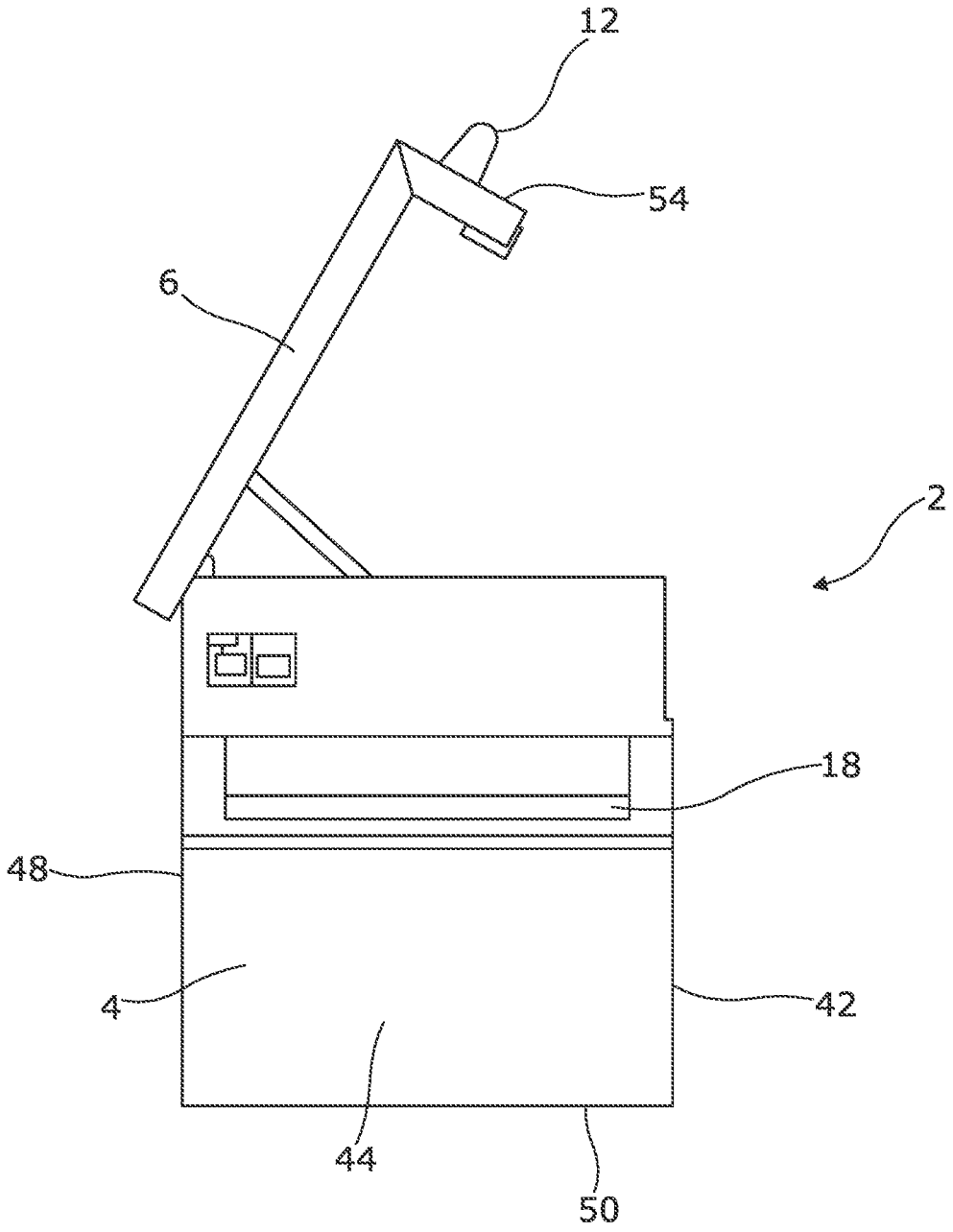

Referring firstly to FIGS. 1*a-c*, there is illustrated apparatus 2 in accordance with one embodiment of the invention. In this embodiment, the apparatus comprises of a body 4 and a lid 6. The body is formed of side walls 42,44,46,48 a base 50 and which define a cavity 52 in which items such as tools can be stored directly or in drawers or trays which are located in the cavity.

In this embodiment access is gained to the cavity 52 by moving a portion ion the form of the lid 6 between the closed, locked position shown in FIG. 1*a* to the open unlocked position shown in FIGS. 1*b* and *c*. The lid 6 is movable about hinge mechanisms 14 as indicated by arrow 16 and when the lid is in the closed position the front wall 54 of the same is substantially flush with the side wall 42 as shown in FIG. 1*a* so as to prevent any attempt to insert a tool such as a bottle jack being used to raise the lid from the body when the lid is locked to the body via the locking mechanism 8.

Figure 1D:
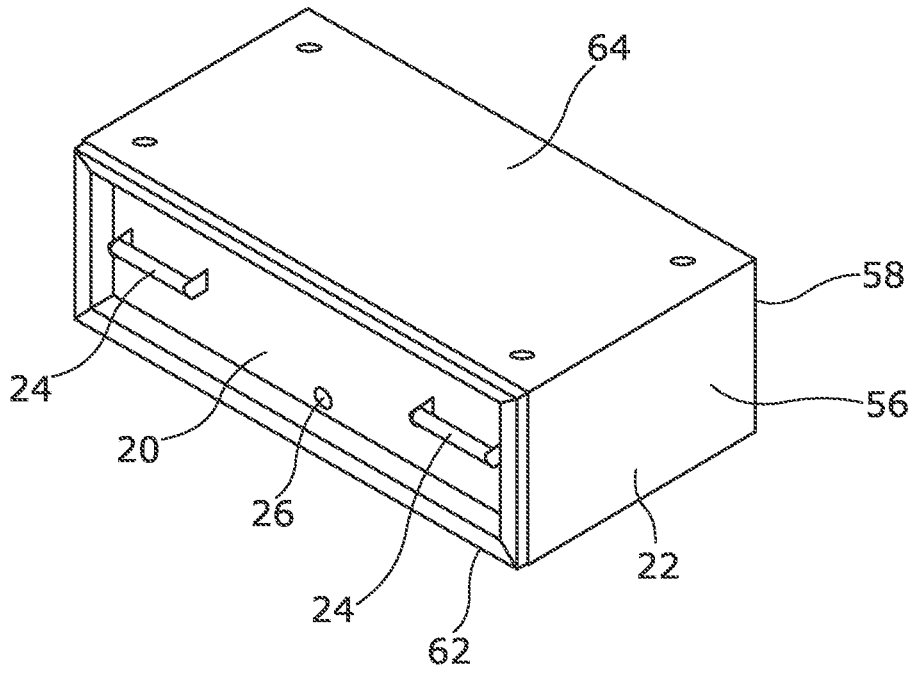
Figure 1E:
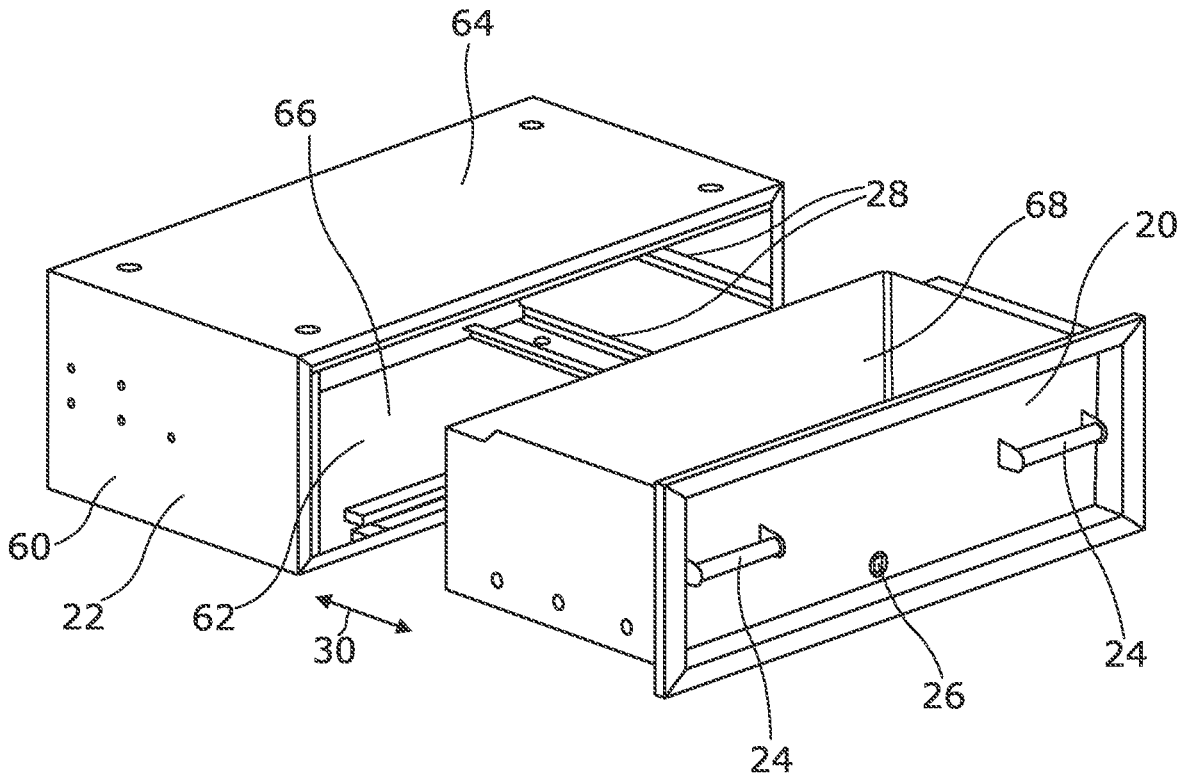

In FIGS. 1*d* and *e*, there is illustrated an alternative embodiment of the invention in which there is again provided a body 22 and this is formed of side walls 56, 58,60, a base 62 and top wall 64 and a front wall in which there is provided an aperture 66 which receives a portion, in this embodiment in the form of a drawer 20 therein and the drawer can be slidably moved as indicated by arrow 30 between the closed, locked, position located in the cavity 52 as shown in FIG. 1*d* and the open position as shown in FIG. 1*e*. In this embodiment the drawer itself includes a space 68 in which the tools are stored and the drawer is again provided with a locking means 26 to lock the drawer to the body.

In the embodiments of FIGS. 1*a-e* locking means 10 may be provided on the base and/or sidewalls of the body 4, 22 so as to allow the same to be secured and locked to a securing surface such as a surface of a building or vehicle.

Figure 1F:
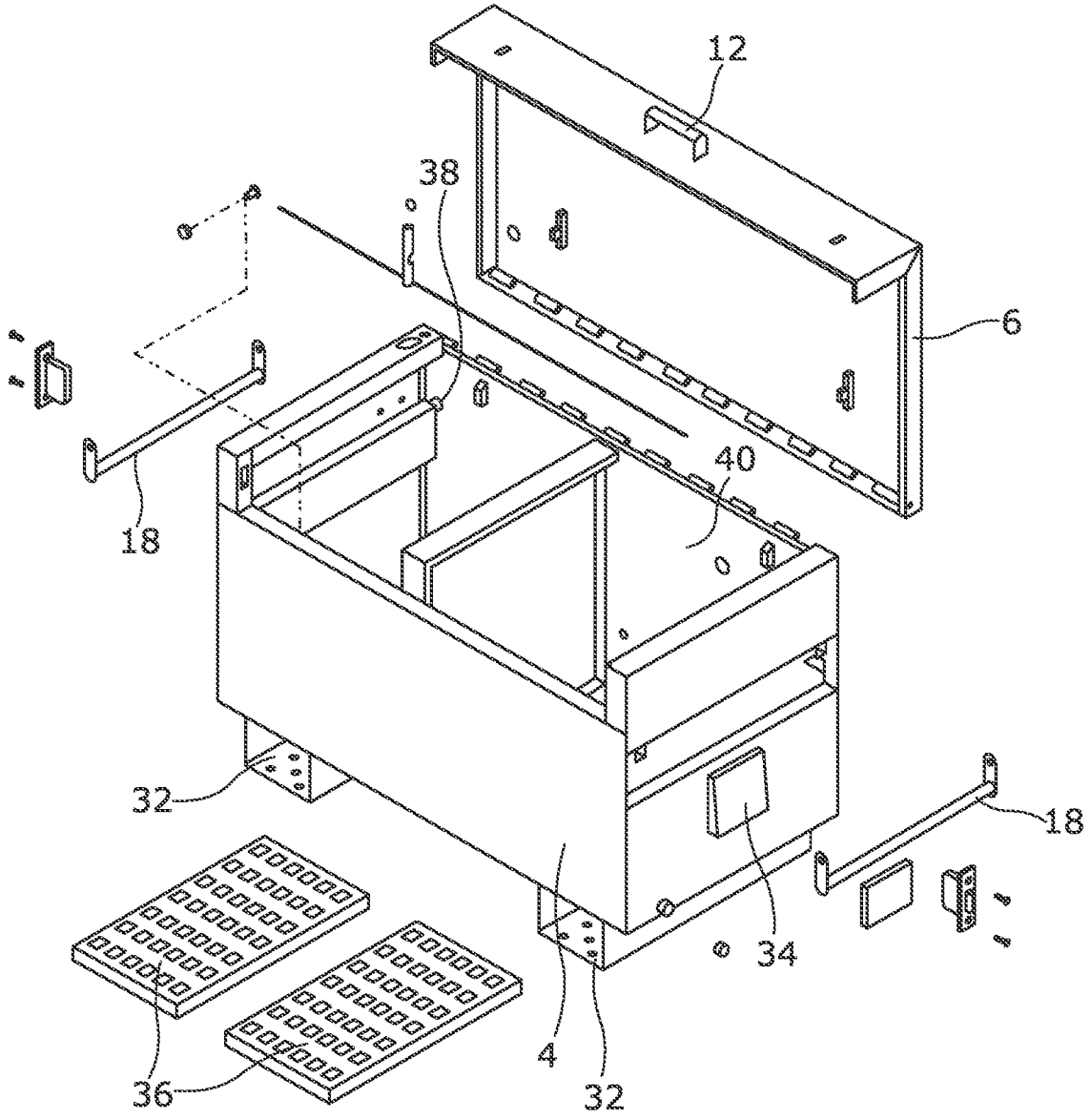

FIG. 1*f* illustrates a further embodiment of the invention which is similar in many features to that of FIGS. 1*a-c* but in this case the cavity 52 in the body 4 is split into two sections, section 38 for the storage of items therein and section 40 for the location of fuel cans therein and includes ventilation racks 36 and vent 34 to prevent fuel fumes from building up inside the cavity. Also, lifting portions 32 are provided to allow the apparatus 2 to be moved by for example a fork lift truck.

The locking means 8, 10, 26 can include a locking mechanism with a number of levers and elongate members which are moved into a locking position when the locking mechanism is operated by an authorised code or key provided to the owner and/or used of the apparatus so as to resist unauthorised movement of the lid if provided and/or drawers if provided. In addition or alternatively the locking means can be bolts or other securing members which pass between the securing structure and the apparatus so as to lock the apparatus to the locking structure and most typically the bolts or securing members can only be accessed to allow release of the same when authorised access is gained to the cavity of the apparatus.

Also shown, for example in FIG. 1*a* is the manner in which all, or a portion 70, of the wall of the apparatus body or lid may be formed of a compound metal or metal alloy structure which has a greater resistance to being cut through and thereby this acts to further secure and prevent access to key security features of the apparatus.

In order to further improve the strength of security of the items within the cavity and/or to prevent theft of the apparatus by removing the same from a securing surface the apparatus is provided with one or more parts which are, or include, sacrificial elements which, typically, are selected to be those parts which are most commonly used to gain unauthorised access to the apparatus cavity and/or which may be judged to be usable to gain unauthorised access.

In the embodiments shown the parts which are or include sacrificial elements are one or more of the handles 12 which are attached to the lid 6, handles 24 attached to the drawer 20 and/or handles 18 which are attached to the body and used to allow the lifting of the apparatus as a whole.

Figure 2A:
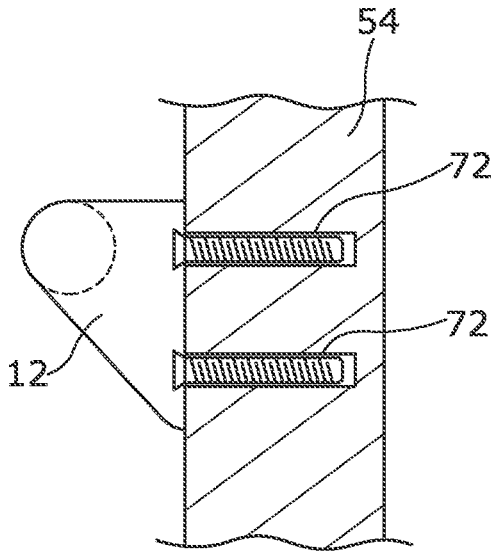
FIGS. 2*a* and *b* illustrate views of a sacrificial part in accordance with one embodiment of the invention.
Figure 2B:
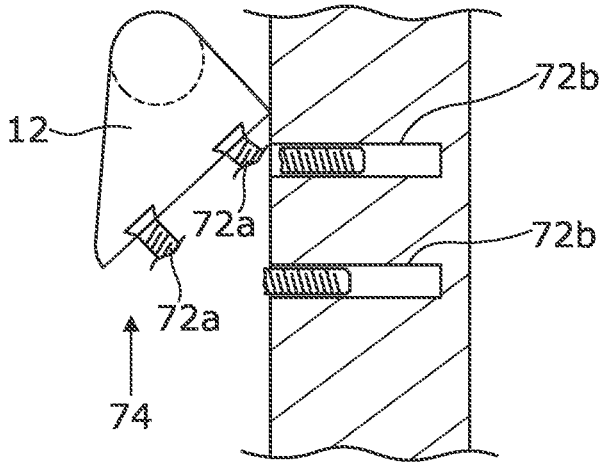

An example of the said part is shown in FIGS. 2*a* and *b* in which, in FIG. 2*a*, a handle 12 is shown in its normal position located, by securing means in the form of screws 72, with the wall 54 of the lid 6 of the apparatus. The screws are the sacrificial elements in this embodiment and are formed, in this embodiment, of nylon and with sufficient strength so as to secure the handle 12 in position to allow the same to be used for its normal function, for example, to be grasped to lift the lid between open and closed positions. However, the screws 72 are also deliberately provided so as only to be usable and remain intact up to a predetermined upper limit of applied force such as that which is sufficient to allow movement of the lid 6 without any significant resistance to that movement. However when a greater force is applied to the handle, such as in the direction of arrow 74 and which is at a level which is required so as to be sufficient to overcome resistance to movement of the lid to an open, such as when the lid is locked closed by the locking means, the screws will break or shear as indicated in FIG. 2*b* so that the handle part breaks and/or is detached from the lid at appoint before sufficient force can be applied to the same to cause the locking mechanism 8 to break. This therefore prevents the part from being used as a means of breaking the locking means and gaining unauthorised access to the cavity. Thus if an excessive force is applied, the screws 72 which secure the handle to the body will break into parts 72*a,b* and hence the handle 12 will be detached from the apparatus and can no longer be used as a means of applying force to gain unauthorised access.

The same will apply if, for example, a force is applied to a part such as a handle or other components, in order to attempt to remove the apparatus from a securing structure such as a van or building and in which case, the attempt to, for example apply chains round the handles, and to hence effectively rip the apparatus out of the vehicle or building, by breaking or dislodging the locking means in the form of bolts or the like, will fail as a result of the breaking of the sacrificial elements first when the force applied exceeds the predetermined upper limit of force applied to the said part and which upper limit will always be less than the predetermined calculated force required to be applied to break the locking means which secure the apparatus to a securing structure or the portion to the body.

The invention claimed is:

1. A storage apparatus including a body formed by a base, top and sidewalls, which define a storage cavity therein, at least one portion of the apparatus moveable between open and closed positions so as to allow access to be gained to the storage cavity when the said at least one portion is in an open position to allow the positioning of items therein and the removal of items therefrom, locking means which allow the said at least one portion to be locked in the closed position and/or the apparatus to be locked to a support structure, wherein the apparatus includes at least one sacrificial element so that upon an attempt being made to gain access to the said cavity and/or remove said apparatus from said securing structure whilst said locking means are locked, by applying a force to, or via at least one part which is, or includes, said sacrificial element, said sacrificial element will break or be at least partially detached from the apparatus so as to reduce the possibility of the said force being applied to said at least one part to a level sufficient to gain access to said cavity and/or remove said apparatus from said securing structure, and wherein the sacrificial element is at least one securing means used to secure the said part to the said at least one portion such that the said part secured by the securing means is detached from the said apparatus by the breaking of the sacrificial element when force at a predetermined level is applied thereto.

2. Apparatus according to claim 1 wherein the level of force applied to cause the sacrificial element to break or be detached is less than the level of force required to break the locking means or otherwise gain access to the cavity.

3. Apparatus according to claim 1 wherein the said at least one part has a function during normal use of the apparatus and the sacrificial element is provided with sufficient strength so as to remain intact in order to allow a level of force to a predetermined level to be applied to the part to allow the same to perform said normal function.

4. Apparatus according to claim 3 wherein the said sacrificial element is breakable or detachable when a level of force in a range greater than the said predetermined level of force and less than the level of force required to break the locking means is applied to said at least one part.

5. Apparatus according to claim 1 wherein the attempt to gain access to the cavity with the locking means locked is to move said at least one portion to an open position so as to allow access to items within said cavity and/or allow further force to be applied to remove said apparatus from a securing structure to which the same is attached.

6. Apparatus according to claim 1 wherein the at least one securing means is a screw or bolt with a known level at which the same will break when force is applied thereto and hence cause the part secured by the screw to detach from the said apparatus.

7. Apparatus according to claim 1 wherein the said part is a handle attached to said at least one portion to enable movement of the said at least one portion between open and closed positions when the said locking means are unlocked.

8. Apparatus according to claim 1 wherein the apparatus is provided to be engaged directly to a securing structure such as a vehicle or a building.

9. Apparatus according to claim 1 wherein the apparatus is located on a securing plate or base which, in turn is secured to a securing structure.

10. Apparatus according to claim 1 wherein the movable portion is a lid moveable about a pivotal axis between open and closed positions.

11. Apparatus according to claim 10 wherein one or more hinge mechanisms are attached to the lid and body of the apparatus to control the movement of the lid and said one or more hinge mechanisms are located entirely within the cavity when the lid is in the closed position.

12. Apparatus according to claim 11 wherein the hinge mechanisms are engaged to sidewalls and/or the lid portion of the apparatus and the engagement means therefore are not visible or accessible from the external surfaces of the apparatus.

13. Apparatus according to claim 10 wherein the lid, when in a closed position, has sidewalls which are substantially flush with the adjacent sidewalls of the body of the apparatus.

14. Apparatus according to claim 1 wherein the at least one portion is one or more drawers provided to be moveable between a closed position in which the same are located within the cavity and an open position at least partially removed from the body.

15. Apparatus according to claim 14 wherein the one or more sacrificial elements are handles and/or securing means to attach said one or more handles, to the one or more drawers.

16. Apparatus according to claim 1 wherein the one or more sacrificial elements are attached to the sidewalls of the apparatus body.

17. Apparatus according to claim 1 wherein one or more portions of the external faces of the apparatus are formed of a compound metal or metal alloy which, when attempts are made to cut through the same, cause respective layers or components of the same to separate.

18. Apparatus according to claim 17 wherein the said one or more portions are located at or adjacent to locking means so as to provide resistance to gaining access to the lock components.

19. Apparatus according to claim 17 wherein the said compound material or metal alloy is located at or adjacent to engagement means for a hinge mechanism for a lid of the apparatus.

20. Apparatus according to claim 1, wherein breaking or detaching the sacrificial element does not allow access to be gained to the storage cavity.

* * * * *